US007040110B2

(12) United States Patent
Nowak

(10) Patent No.: US 7,040,110 B2
(45) Date of Patent: May 9, 2006

(54) DISPENSING UNIT LIGHTING SYSTEM

(75) Inventor: David R. Nowak, Chicago, IL (US)

(73) Assignee: Illinois Tool Works Inc, Glenview, IL (US)

( * ) Notice: Subject to any disclaimer, the term of this patent is extended or adjusted under 35 U.S.C. 154(b) by 92 days.

(21) Appl. No.: 10/860,421

(22) Filed: Jun. 3, 2004

(65) Prior Publication Data

US 2005/0044871 A1 Mar. 3, 2005

Related U.S. Application Data

(60) Provisional application No. 60/499,544, filed on Sep. 2, 2003.

(51) Int. Cl.
*F25D 23/00* (2006.01)

(52) U.S. Cl. ..... 62/264; 62/389; 222/146.6

(58) Field of Classification Search ..... 62/188, 62/264, 389, 391; 362/92, 96, 276; 250/227.14; 200/230; 222/146.6
See application file for complete search history.

(56) References Cited

U.S. PATENT DOCUMENTS 4,710,858 A * 12/1987 Van Hout et al. ..... 362/95
4,851,662 A * 7/1989 Ott et al. ..... 250/214 AL
4,853,505 A * 8/1989 Sorenson ..... 200/315
4,870,232 A * 9/1989 Hoogland ..... 200/331
4,974,643 A * 12/1990 Bennett et al. ..... 141/1
5,297,010 A * 3/1994 Camarota et al. ..... 362/501
5,575,552 A * 11/1996 Faloon et al. ..... 362/492
6,263,259 B1 * 7/2001 Bartur ..... 700/240
6,667,544 B1 * 12/2003 Glenn ..... 257/686
6,791,282 B1 * 9/2004 Vinocur et al. ..... 315/291
6,804,974 B1 * 10/2004 Voglewede et al. ..... 62/264
2001/0025208 A1 * 9/2001 Bartur ..... 700/231
2005/0173046 A1 * 8/2005 Savoie et al. ..... 156/101

FOREIGN PATENT DOCUMENTS

GB 2191326 A * 12/1997

* cited by examiner

*Primary Examiner*—Mohammad M. Ali
(74) *Attorney, Agent, or Firm*—Paul F. Donovan; Mark W. Croll

(57) ABSTRACT

A lighting system for dispensing units such as ice and water dispensers on refrigerators includes a paddle on a shaft for activating and deactivating the dispenser by force applied from a receptacle. The shaft is configured as a light tube. A light source is positioned above the shaft to supply light into the shaft and paddle in the non-deflected condition. A prism is provided to receive light from the light source when the paddle is depressed, and to redirect light from the light source towards a receptacle positioned for receiving ice or water dispensed by the dispenser.

17 Claims, 2 Drawing Sheets

DISPENSING UNIT LIGHTING SYSTEM

CROSS-REFERENCE TO RELATED APPLICATIONS

The present regular United States patent application claims the benefits of U.S. Provisional Application Ser. No. 60/499,544, filed on Sep. 2, 2003.

FIELD OF THE INVENTION

The present invention relates generally to paddle operated dispensing units wherein a paddle is depressed by a receptacle to dispense a product into the receptacle, and, more specifically, the invention pertains to a lighting system for such a dispensing unit.

BACKGROUND OF THE INVENTION

Paddle operated dispensing units are known for many purposes. A basic design for such units includes a lever having an enlarged portion or paddle for engaging a receptacle, with the lever connected to a valve or other mechanism associated with the dispenser for starting and stopping the dispensing of a product into the receptacle. Paddle operated dispensing units are known for use on refrigerators in dispensing units for both ice and chilled water. The paddle is depressed by pushing a glass or cup against the paddle, which activates the dispensing unit to dispense the water or ice into the receptacle.

It is known to provide the paddle within a recessed area or alcove of the refrigerator. If the small, recessed area is lit only from ambient light sources, the recess is dim with the paddle at the back thereof difficult to see. Therefore, various approaches to lighting the recessed area have been used with varying degrees of success. Incandescent bulbs have been placed at the top of the recessed area, directing light generally into the recessed area. If the light is dim, the paddle may not be adequately lit, remaining difficult to see. If the light is sufficiently bright to light the paddle, the entire recessed area of the dispensing unit may be objectionably bright and a distraction from an aesthetic reference. The incandescent light is also a source of unwanted heat for dispensing units of ice or chilled water. Further, incandescent bulbs require relatively high voltage to operate and have a generally short life span, requiring frequent replacement throughout the life of the appliance.

LED's have been used in place of incandescent bulbs, in attempts to address some of the problems associated with using incandescent bulbs for dispenser lighting systems. A problem with known uses of LED's to light dispensers is the generally poor light output due to not fully utilizing the light emitted from the LED's. For example, LED's have been positioned behind clear paddles to illuminate the paddles. A problem with this arrangement is that because the light source is behind the paddle, the light is not directed towards or into the cup, thereby limiting the light effect for the user. As another example, LED's have been mounted above the ice and water dispenser to shine down onto the paddles. A problem with this arrangement is that if the LED's are not properly positioned over the paddles, the light hitting the paddles, or hot spots, may not be centered, which provides an undesirable appearance aesthetically.

It is desirable that the paddle be lit adequately so that users having receptacles of various sizes and shapes can readily observe the paddle, to position properly the receptacle against the paddle for operation of the dispenser. However, a brightly lit recess can be objectionable aesthetically.

A further problem concerns seeing the level of water, for example, as it fills the receptacle. Without lighting, it is easy to overfill a glass or cup, particularly if the glass or cup is dark in color. Known lighting systems have not provided adequate light to the inside of the receptacle.

What is needed is a lighting system for dispensers that provides clear, yet subtle lighting of the paddle and light directed into the receptacle so that the level of filling is readily observable.

SUMMARY OF THE INVENTION

The present invention provides a paddle that functions as a light tube, receiving light from a light source, and a prism to redirect light into a receptacle with the paddle is depressed.

In one aspect thereof, the present invention provides a lighting system for a dispensing unit having an actuator connected to a dispenser to activate and deactivate the dispenser by depressing the actuator with a receptacle for receiving a product dispensed by the dispensing unit. The lighting system has a light source, and at least a portion of the actuator is configured as a light tube and positioned in a non-depressed condition for receiving light from the light source. A target area of the actuator is illuminated by light from within the portion configured as a light tube.

In another aspect thereof, the present invention provides a dispensing unit with a dispenser and an actuator having a shaft with a connected end operatively associated with the dispenser and a distal end configured as a paddle. The actuator is operatively associated with the dispenser for activating and deactivating the dispenser by depressing and releasing the paddle. The shaft is configured as a light tube, and the paddle is adapted for external illumination by light from within the paddle conducted through the shaft. A light source near the connected end of the actuator supplies light to the light tube.

In a further aspect thereof, the present invention provides a method for using a dispensing unit. The method has steps of providing a dispenser and an actuator for the dispenser, the actuator having a shaft in the form of a light tube connected to the dispenser and a paddle at a distal end of the shaft. The paddle is configured for external illumination by light from within the paddle conducted through the shaft. The method further includes providing a light source near the end of shaft; transferring light from the light source through the tube and into the paddle; and illuminating the paddle with light from within.

In a still further aspect thereof, the present invention provides a dispensing unit with a dispenser and an actuator operatively associated with the dispenser for activating and deactivating the dispenser by depressing and releasing the paddle. A light source is near the actuator and positioned for illuminating the actuator. A light director is positioned for receiving and redirecting light from the light source when the actuator is depressed.

An advantage of the present invention is providing a lighting system for dispensing units which provides clear, yet subtle lighting of the paddles, including lighting of the paddle edges so that the paddle is readily discernible.

Another advantage of the present invention is providing a dispensing unit lighting system that provides adequate lighting to the inside of a receptacle for ready observance of the fill level in the receptacle.

A further advantage of the present invention is providing a lighting system for dispensing units which is simple, reliable, long lasting and has low energy usage.

Other features and advantages of the invention will become apparent to those skilled in the art upon review of the following detailed description, claims and drawings in which like numerals are used to designate like features.

Figure 2:
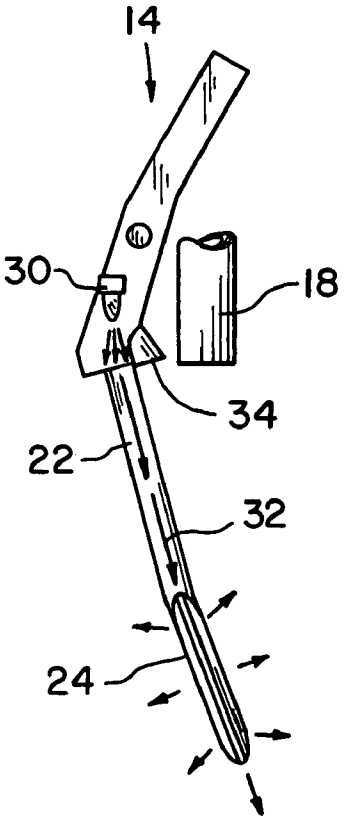
FIG. 2 is a side view of the dispensing unit shown in FIG. 1.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Figure 1:
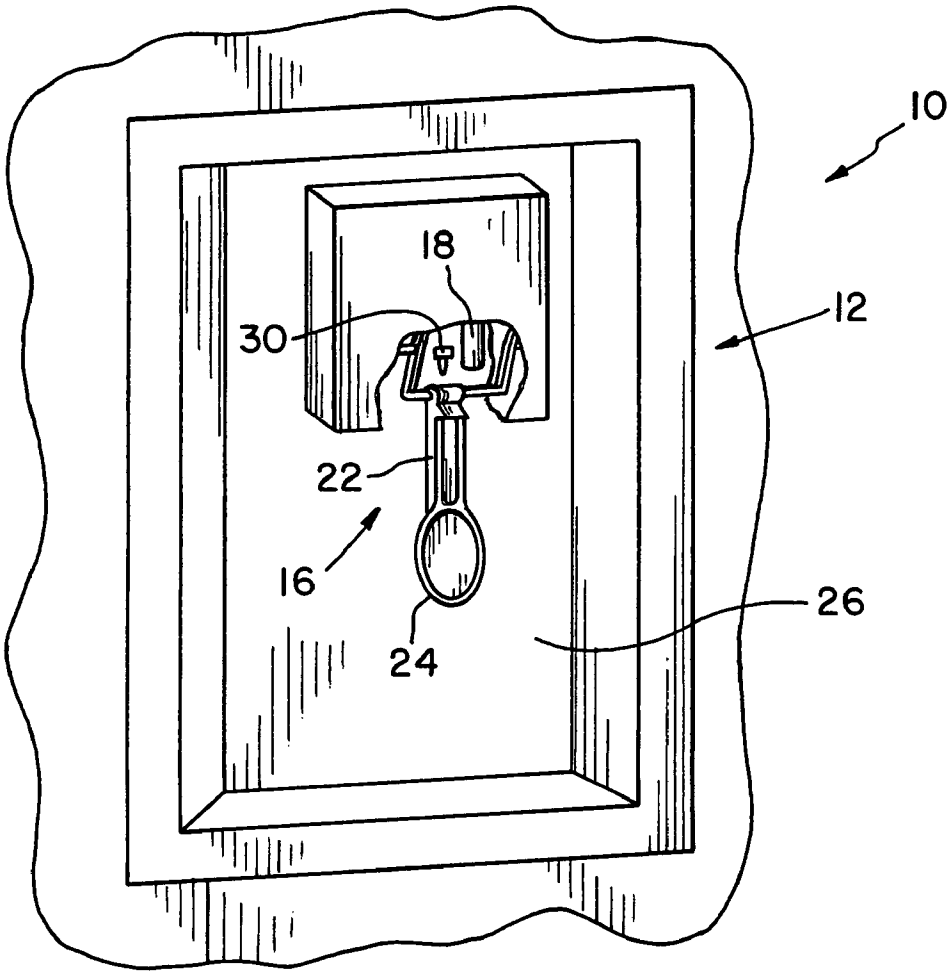
FIG. 1 is a perspective view of a refrigerator dispensing unit having a lighting system in accordance with the present invention.

Referring now more specifically to the drawings and to FIG. 1 in particular, numeral 10 designates a refrigerator having a dispensing unit 12 in accordance with the present invention. Dispensing unit 12 includes a dispenser 14 and an actuator 16. Dispensing unit 12 can be for dispensing chilled water or ice from refrigerator 10. Refrigerator 10 can include two dispensing units 12, one for ice and one for water. Further, while shown and described herein for use on a refrigerator, it should be understood that the present invention has application and use for dispensing units of a variety of types, including commercial dispensing units as well as residential dispensing units. The present invention also can be used on dispensers of specialty beverages and the like.

Dispenser 14 is connected to a source of the product to be dispensed from an outlet 18 into a receptacle 20 (FIGS. 3 and 4), such as, for example a cup or glass or 20. Those skilled in the art will readily understand that when used for dispensing ice or water from a residential refrigerator 10, dispenser 14 is connected to a source of ice cubes in a freezer compartment of refrigerator 10 or to a water source connected to refrigerator 10. When connected to a source of ice cubes for dispensing into receptacle 20, dispenser 14 may include a transport mechanism for moving ice cubes and upon activation thereof transports ice cubes to outlet 18. When connected to a source of water, dispenser 14 may include a valve (not shown) which is opened or closed for the dispensing of water into receptacle 20 from outlet 18. Outlet 18 is depicted as a simple tube 18 in the drawings, but can be shaped as provided for the product to be dispensed.

To activate mechanisms within dispenser 14 and commence the flow of product, actuator 16 is in the form of a lever having a shaft 22 operatively connected to dispenser 14, and an enlarged end or paddle 24 at a distal end of shaft 22. As known to those skilled in the art, dispenser 14 is activated by pressing receptacle 20 against paddle 24. The manner in which dispenser 14 is actuated by actuator 16 is well known to those skilled in the art and will not be described in further detail herein.

The present invention provides a lighting system for illuminating paddle 24 in the relaxed position, and to light the interior of receptacle 20 when product is being dispensed therein, without unduly lighting a recess or alcove 26 in which actuator 16 and outlet 18 are positioned. Shaft 22 and paddle 24 are preferably provided of clear polycarbonate, with shaft 22 formed as a light tube for the transmission of light therethrough directly to paddle 24. Edges of paddle 24 can be thinned or otherwise configured so as to provide a brighter area or glow along the edges of paddle 24, thus better illuminating the edges of paddle 24 and highlighting a target area thereof to be pushed against by receptacle 20. The edges of paddle 24 can be configured to direct the pattern of light in a preferred manner.

The lighting system for dispensing unit 12 further includes a light source 30, which preferably is an LED or other low energy light source providing adequate light for the application. Light source 30 is configured and positioned such that when actuator 16 is in a relaxed or non-depressed condition, LED 30 is positioned directly above shaft 22, and most of the light from LED 30, indicated by arrows 32, is transmitted through shaft 22 and into paddle 24. Paddle 24 is adequately lit internally, capturing sufficient light from light source 30. However, paddle 24 is lit subtly, being readily discernable within alcove 26 without significant light directed into alcove 26. Thus, the location of paddle 20 is readily discernible for the proper placement of receptacle 20 thereagainst, yet the front of refrigerator 10 remains aesthetically pleasing without an objectionably bright highlight therein.

To light the interior of receptacle 20, a light director 34 is provided, redirecting light from source 30 when actuator 16 has been depressed. Light director 34 as shown is a prism 34, but a lens, mirror and other light controlling structure or structures also can be used. Light director 34 receives significant light (designated by arrows 32) from light source 30 only when actuator 16 has been depressed, most of the light from source 30 otherwise being directed into shaft 22. Thus, prism 34 functions to redirect light from light source 30 into the front area of alcove 26 and receptacle 20 only when product, such as a stream of water 36 is being dispensed into receptacle 20.

Figure 4:
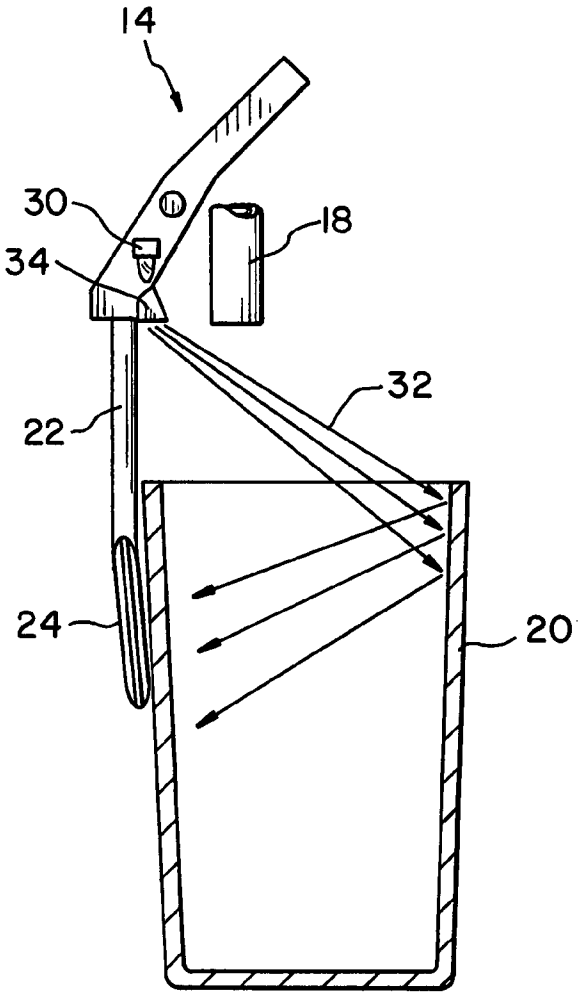
FIG. 4 is a side view similar to that of FIG. 3, but illustrating a further embodiment of the invention.
Figure 3:
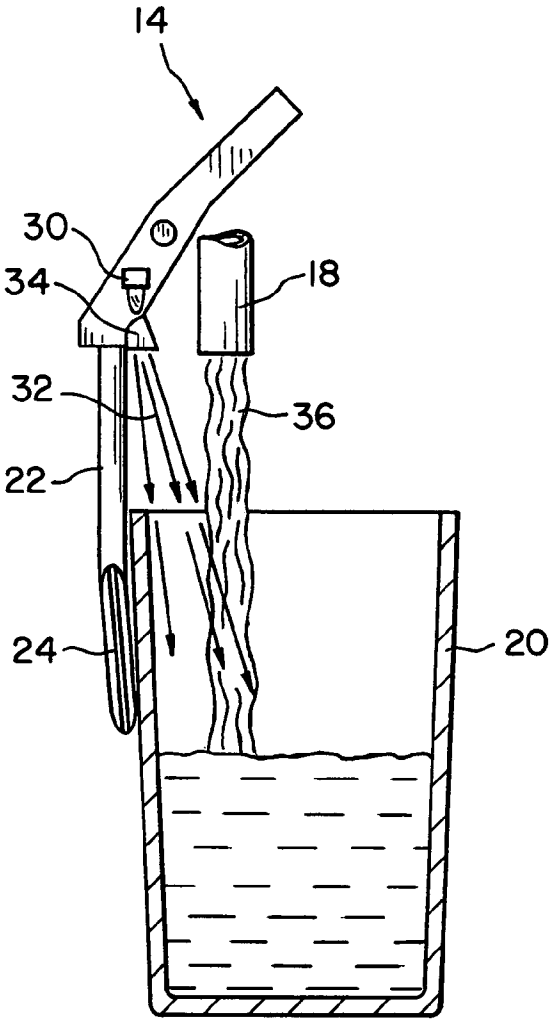
FIG. 3 is a side view similar to that of FIG. 2, but showing the paddle depressed by a glass (shown in cross-section) for dispensing a product into the glass.

Light director 34 may direct light (indicated by arrows 32) into receptacle 20 directly from the top thereof, generally at the inner edge thereof, as shown in FIG. 3. However, the interior of receptacle 20 can be lit in another manner by positioning the light director 34 to direct light 32 against the inner surface of receptacle 20 furthest from light source 30, as shown in FIG. 4. That is, redirected light 32 first strikes the inner surface area of receptacle 20 nearest the user, and then is reflected back towards the opposite side, thereby lighting the interior of receptacle 20. Alternatively, the interior of receptacle 20 can be lit by positioning the light director 34 to direct light 32 against the inner surface of receptacle 20 closest from light source 30. In other words, redirected light 32 first strikes the inner surface area of receptacle 20 farthest from the user to light the interior of the receptacle 20. If desired, the light can also be reflected back towards the opposite side to further light the interior of receptacle 20.

Prism 32 can be fixed in position to receive minimal light when actuator 16 is not deflected, with most of the light entering shaft 22 and paddle 24, as illustrated in FIG. 2. When paddle 24 is pressed and the end of shaft 22 moved less light enters shaft 22. Light from light source 30 will reach director 34 for redirection into receptacle 20. In some installations and uses of the present invention, it may be preferred to have director 34 connected to an arm or other structure connected to actuator 16, so that director 34 is moved more directly into the light path from light source 30 when paddle 24 is depressed.

By illuminating the paddle from within, instructions or advertising information can be communicated to a user of the dispenser. Such information can be placed on a surface of paddle 24 and illuminated from within for easy reading.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A lighting system for a dispensing unit having an actuator connected to a dispenser to activate and deactivate the dispenser by depressing the actuator with a receptacle for receiving a product dispensed by said dispensing unit, said lighting system comprising:

a light source;

at least a portion of said actuator configured as a light tube and positioned in a non-depressed condition for receiving light from said light source; and a target area of said actuator illuminated by light from within said portion configured as a light tube when in the non-depressed condition, said actuator being further configured such that in a depressed condition, said target area of said actuator is moved away from the light from said light source such that the light from said light source illuminates at least one of the receptacle and product dispensed by said dispensing unit.

2. The lighting of system of claim 1, said light source being an LED.

3. The lighting of system of claim 1, said actuator including a shaft configured as a light tube and positioned to receive light therein from said light source.

4. The lighting of system of claim 3, said actuator including a paddle at an end of said shaft, said paddle configured for illumination from within by light from said shaft.

5. The lighting system of claim 1, including a light director for redirecting light from said light source when said actuator is depressed.

6. The lighting system of claim 5, said light director being in fixed position.

7. The lighting of system of claim 5, said light source being an LED.

8. The lighting system of claim 5, said light director being a prism.

9. The lighting system of claim 5, said light director positioned and configured with respect to said light source for redirecting light from said light source toward an inner surface of the receptacle pressed against said actuator.

10. A dispensing unit comprising:

a dispenser;

an actuator having a shaft with a connected end operatively associated with said dispenser and a distal end configured as a paddle, said actuator operatively associated with said dispenser for activating and deactivating said dispenser by depressing and releasing said paddle, said shaft being configured as a light tube and said paddle being adapted for external illumination by light from within said paddle conducted through said shaft; and a light source near said connected end of said actuator, said light source supplying light to said light tube when said actuator is in a non-depressed position, and said light source supplying light away from said actuator when said actuator is in a depressed position.

11. The dispensing unit of claim 10, including a light director for redirecting light from said light source when said paddle is depressed.

12. The dispensing unit of claim 11, said light director being in fixed position.

13. The dispensing unit of claim 11, said light director being a prism.

14. The dispensing unit of claim 11, said light source being an LED.

15. The dispensing unit of claim 10, said light source being an LED.

16. A dispensing unit comprising:

a dispenser;

an actuator operatively associated with said dispenser for activating and deactivating said dispenser by depressing and releasing said actuator;

a light source near said actuator, said light source positioned for illuminating said actuator, said actuator acting as a light tube transmission of light directly therethrough when said actuator is in a non-depressed position; and a light director positioned for receiving and redirecting light from said light source when said actuator is depressed, said light director positioned so as to receives significant light from said light source only when said actuator has been depressed.

17. The dispensing unit of claim 16, said light director being a prism.

* * * * *